US010877504B2

(12) United States Patent
Aboudina et al.

(10) Patent No.: US 10,877,504 B2
(45) Date of Patent: Dec. 29, 2020

(54) LOW-VOLTAGE REFERENCE CURRENT CIRCUIT

(71) Applicant: SHENZHEN GOODIX TECHNOLOGY CO., LTD., Shenzhen (CN)

(72) Inventors: Mohamed Aboudina, San Diego, CA (US); Ahmed Emira, San Diego, CA (US); Hassan Elwan, San Diego, CA (US)

(73) Assignee: SHENZHEN GOODIX TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 16/557,808

(22) Filed: Aug. 30, 2019

(65) Prior Publication Data

US 2019/0384343 A1 Dec. 19, 2019

Related U.S. Application Data

(63) Continuation of application No. 15/993,629, filed on May 31, 2018, now Pat. No. 10,429,877.

(51) Int. Cl.
*G05F 3/26* (2006.01)

(52) U.S. Cl.
CPC ..... *G05F 3/262* (2013.01)

(58) Field of Classification Search
None
See application file for complete search history.

(56) References Cited

U.S. PATENT DOCUMENTS

| | | | | |
|---|---|---|---|---|
| 5,394,079 | A | 2/1995 | Llewellyn | |
| 7,218,170 | B1 | 5/2007 | Carter et al. | |
| 8,654,600 | B1 | 2/2014 | Pollachek | |
| 2010/0157672 | A1* | 6/2010 | Barkley | G11C 7/04 365/185.03 |
| 2012/0025801 | A1 | 2/2012 | Hirose et al. | |
| 2018/0101190 | A1* | 4/2018 | Lee | G05F 3/30 |

FOREIGN PATENT DOCUMENTS

| | | |
|---|---|---|
| CN | 104090625 A | 10/2014 |
| CN | 105867518 A | 8/2016 |

OTHER PUBLICATIONS

Extended European Search Report dated Oct. 16, 2019 in the corresponding EP application (application No. 18865352.1).
European examination report dated Jul. 16, 2020 in the corresponding EP application (application No. 18865352.1).
"Current source—Wikipedia, the free encyclopedia", Oct. 28, 2012, total 12 pages, XP055259374.

* cited by examiner

*Primary Examiner* — Cassandra F Cox
(74) *Attorney, Agent, or Firm* — Kilpatrick Townsend & Stockton LLP

(57) ABSTRACT

A semiconductor device includes a current source, an input/output (IO) region having a first IO device and a second IO device, and a core region having a core device. The first and second IO devices form with the current source a current mirror circuit. Each of the first and second IO devices has a first threshold voltage, and the core device has a second threshold voltage that is lower than the first threshold voltage. The first core device is coupled to the first and second IO devices and the current source and provides an offset voltage to the current source.

19 Claims, 3 Drawing Sheets

LOW-VOLTAGE REFERENCE CURRENT CIRCUIT

FIELD OF THE INVENTION

This application claims priority to U.S. patent application Ser. No. 15/993,629, filed on May 31, 2018, entitled "Low Voltage Reference Current Circuit," the disclosure of which is hereby incorporated by reference in its entirety for all purposes.

FIELD OF THE INVENTION

The present invention relates generally to current reference circuits, and more particularly to current reference circuits that operate at low voltages.

BACKGROUND OF THE INVENTION

Integrated circuit components continue to shrink in size, and demands in battery-powered devices continue to increase. Reference current circuits are widely used in integrated circuits to generate bias currents. However, as supply voltages fall, some commonly used reference current circuits can no longer operate or operate poorly under low voltage conditions. Thus, the supply voltage represents one of the challenges in the design of reference current circuits. Most analog systems are supplied with a battery voltage. Generating a reference current from a battery voltage generally provides good performance in terms of leakage current and output resistance, but with a relatively high power consumption. Generating a reference current from a low supply voltage enables a small silicon area and low power consumption, but requires the use of core devices that have the drawbacks of current leakage and low output resistance. Further, as the supply voltage decreases, conventional reference current circuits may not function properly. Another challenge is the low noise requirement. A low noise reference current circuit requires filter capacitors, however, a gate leakage current flowing through the filter capacitors causes a voltage shift in the current mirror circuit of the reference current circuit, thereby affecting the matching of the current mirror circuit. Yet another challenge is the required accuracy of the reference current circuit. Thus, a low supply voltage faces the problems of a current leakage that can significantly affect a current mirror performance, and a low output resistance of a current mirror may require an output buffer to drive an output load.

Accordingly, there is a need for improved circuits for generating an accurate low-noise current reference with low supply voltages.

BRIEF SUMMARY OF THE INVENTION

Embodiments of the present application provide a novel current reference circuit that operates at a low voltage supply. In one aspect of the present invention, a current reference circuit may include a current source, a first p-channel metal oxide semiconductor (PMOS) transistor having a source coupled to a first supply voltage, a gate, and a drain coupled to the current source, and an n-channel MOS (NMOS) transistor having a drain coupled to a second supply voltage, a gate coupled to the drain of the first PMOS transistor. The current reference circuit also includes a first resistive element having a first terminal coupled to a source of the NMOS transistor and a gate of the first PMOS transistor and a second terminal coupled to a ground potential, a second PMOS transistor having a drain coupled to the first supply voltage, and a second resistive element having a first terminal coupled to the first terminal of the first resistive element and a second terminal coupled to the gate of the second PMOS transistor.

In another aspect of the present invention, a current mirror may include a current source, a first p-channel metal oxide semiconductor (PMOS) transistor having a source coupled to a first supply voltage, a gate, and a drain coupled to the first current source, a second PMOS transistor having a source coupled to the first supply voltage, a gate coupled to the gate of the first PMOS transistor, and a drain configured to provide a second current source, and an n-channel MOS (NMOS) transistor having a drain coupled to a second supply voltage, a gate coupled to the first current source, and a source coupled to the gate of the first PMOS transistor.

The following detailed description together with the accompanying drawings will provide a better understanding of the nature and advantages of the present invention.

BRIEF DESCRIPTION OF THE DRAWINGS

The accompanying drawings, referred to herein and constituting a part hereof, illustrate embodiments of the disclosure. The drawings together with the description serve to explain the principles of the invention.

DETAILED DESCRIPTION OF THE INVENTION

The present invention will be understood more fully from the detailed description given below and from the accompanying drawings of the preferred embodiments of the invention, which, however, should not be taken to limit the invention to the specific embodiments, but are for explanation and understanding only. The embodiments are described in sufficient detail to enable one of skill in the art to practice the invention. Other embodiments may be utilized and structural, logical, and electrical changes may be made without departing from the scope of the present invention.

It will be understood that, when an element or component is referred to as "adjacent to," "connected to," or "coupled to" another element or component, it can be directly adjacent to, connected or coupled to the other element or component, or intervening elements or components may also be present. In contrast, when an element is referred to as being "directly connected to," or "directly coupled to" another element or component, there are no intervening elements or components present between them. It will be understood that, although the terms "first," "second." "third," etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

The terms "a", "an" and "the" may include singular and plural references. It will be further understood that the terms "comprising", "including", having" and variants thereof, when used in this specification, specify the presence of stated features, steps, operations, elements, and/or components, but do not preclude the presence or addition of one or more other features, steps, operations, elements, components, and/or groups thereof. Furthermore, as used herein, the words "and/or" may refer to and encompass any possible combinations of one or more of the associated listed items.

The use of the terms first, second, etc. do not denote any order, but rather the terms first, second, etc. are used to distinguish one element from another. Furthermore, the use of the terms a, an, etc. does not denote a limitation of quantity, but rather denote the presence of at least one of the referenced items. The terms "current reference circuit," "current reference device," "current mirror," "current mirror circuit," and "current mirror device" are used interchangeably.

Figure 1:
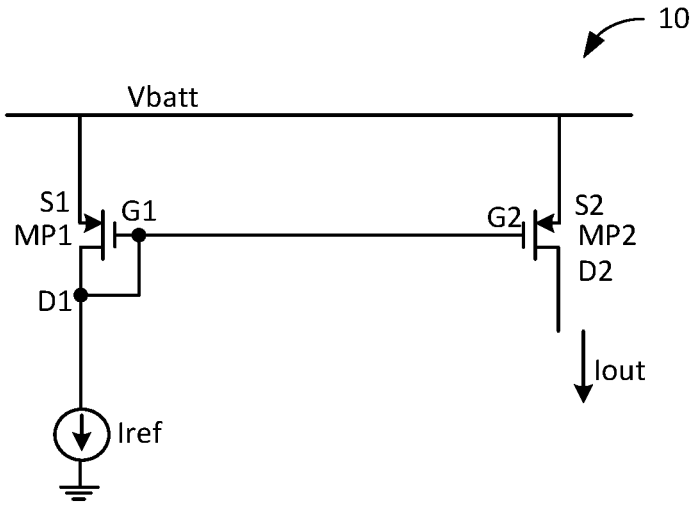
FIG. 1 is a schematic diagram of a current mirror circuit used as a reference circuit for explaining embodiments of the present invention.

FIG. 1 is a schematic diagram of a current mirror circuit 10 used as a reference for explaining embodiments of the present invention. Current mirror circuit 10 includes two matching p-channel metal oxide semiconductor (MOS) transistors MP1 and MP2, and a current reference source Iref. MP1 has a source S1 coupled to a battery supply voltage Vbatt, a gate G1 and a drain D1 coupled together forming a diode. MP2 has a source S2 coupled to the battery supply voltage Vbatt, a gate G2 coupled to the gate G1 of MP1, and a drain D2 that provides an output current Iout to a load. Since the gates of MP1 and MP2 are connected together, when MP1 and MP2 have the same dimension (e.g., W/L ratio), the output current Iout is equal to the current reference source Iref.

As discussed in the background section, continuing reduction in feature sizes of semiconductor devices provides improvement in device performance in terms of lower power consumption and higher switching speed. MOS transistor performance may be improved by reducing the thickness of the gate dielectric layer. However, a thin gate dielectric layer may result in gate tunneling leakage currents, especially at high supply voltages. Therefore, a semiconductor device may have a core region having a low-voltage power source and an input/output (IO) region having a high-voltage power source. The core region includes core devices that have low-threshold voltages (e.g., 04V to 0.5V), and the IO region includes IO devices that have high-threshold voltages (e.g., 0.9V to 1.0V). The threshold voltage of a MOS transistor is defined as the gate voltage required to turn the transistor on or off depending upon the type of the transistor. As used herein, a high-voltage power source may have a supply voltage that is the battery voltage (e.g., 1.5V to 4.5V), and a low-voltage power source may have a supply voltage that is lower than the battery voltage (e.g., 1.0V or less).

Current mirror circuit 10 works well when the supply voltage Vbatt is sufficient high to provide certain voltage headroom for the p-channel MOS transistors and the current reference source. For example, the p-channel MOS transistors are disposed in the input/output (IO) region of an integrated circuit, the voltage across the drain and source of the p-channel MOS transistor MP1 may be about 1V to be in the saturation region, and the voltage at the current reference source Iref may be greater than 0.5V for its proper operation. That is, current mirror circuit 10 can only functions properly with a supply voltage greater than 1.5V.

Figure 2:
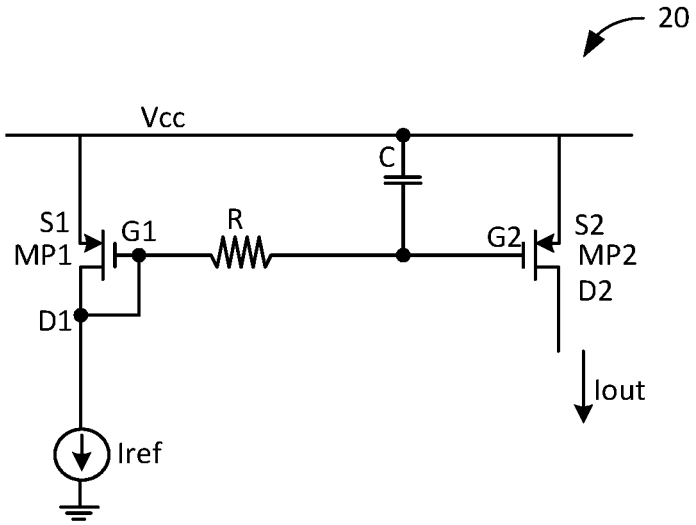
FIG. 2 is a schematic diagram of another current mirror circuit used as a reference circuit for explaining embodiments of the present invention.

FIG. 2 is a schematic diagram of a low-noise current mirror circuit 20 that is a modification of current mirror circuit 10 of FIG. 1. Referring to FIG. 2, the p-channel transistors MP1 and MP2 are located in the core region of an integrated circuit so that they can operate at a lower drain-source voltage, e.g., at about 0.5V. In the embodiment, the voltage at the current reference source Iref may be about 0.4V for a proper operation. That is, current mirror circuit 20 may operate with a core voltage supply Vcc in the range between 0.9V and 1.0V. Current mirror circuit 20 also includes a resistor R having a resistance value that is coupled between the gates of the p-channel MOS transistors MP1 and MP2, and a capacitor C having a capacitance value that is coupled between the supply voltage Vcc and the gate G2 of the p-channel MOS transistor MP2. The resistor R and the capacitor C form a low-pass filter that filters high frequency contents of the current reference source Iref that is above the cut-off frequency of the low-pass filter. The cut-off frequency is defined by the time constant RC of the low-pass filter.

Thus, the RC low-pass filter can filter out noise of the current reference source Iref. However, the low-pass filter may cause a gate tunneling current leakage due to the thin gate dielectric layer that adversely affects the current mirroring performance of current mirror circuit 20 when the transistors MP1 and MP2 each are core devices. Further, the current reference source Iref rises with the supply voltage Vcc and affects thus the performance of current mirror circuit 20. Thus, it is desirable to have transistors with higher threshold voltages to reduce current leakage and power consumption by using IO devices for the transistors MP1 and MP2. Unfortunately, IO devices with higher threshold voltages require higher supply voltages.

Figure 3A:
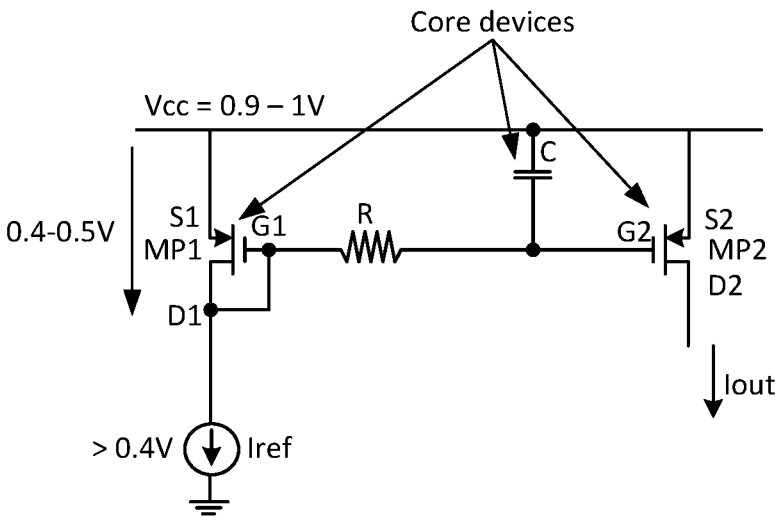
FIG. 3A is a circuit diagram illustrating exemplary voltage values of the low-noise current mirror circuit of FIG. 2 when the transistor MP1 and MP2 are core devices.
Figure 3B:
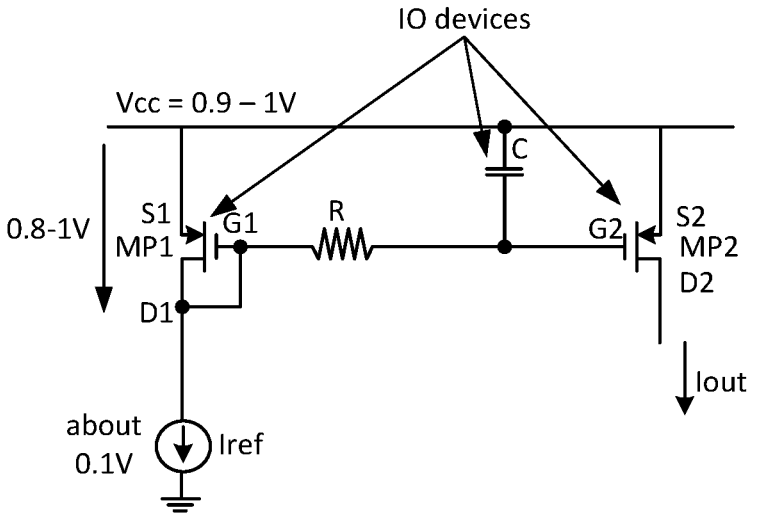
FIG. 3B is a circuit diagram illustrating exemplary voltage values of the current mirror circuit of FIG. 2 when the transistor MP1 and MP2 are IO devices.

FIG. 3A is a circuit diagram illustrating exemplary voltage values of the low-noise current mirror circuit of FIG. 2 when the transistor MP1 and MP2 are core devices. FIG. 3B is a circuit diagram illustrating exemplary voltage values of the current mirror circuit of FIG. 2 when the transistor MP1 and MP2 are IO devices. Referring to FIG. 3A, the transistors MP1 and MP2 are core devices each having a threshold voltage of about 0.4V to 0.5V so that there is a voltage of greater than 0.4V available for the current reference Iref. In contrast, referring to FIG. 3B, the transistors MP1 and MP2 are IO devices each having a relatively high threshold voltage of about 0.8V to 1V so that the current mirror circuit does not have a sufficient voltage margin for the operation of the current reference Iref when IO devices are used at low core-supply voltages.

Figure 4:
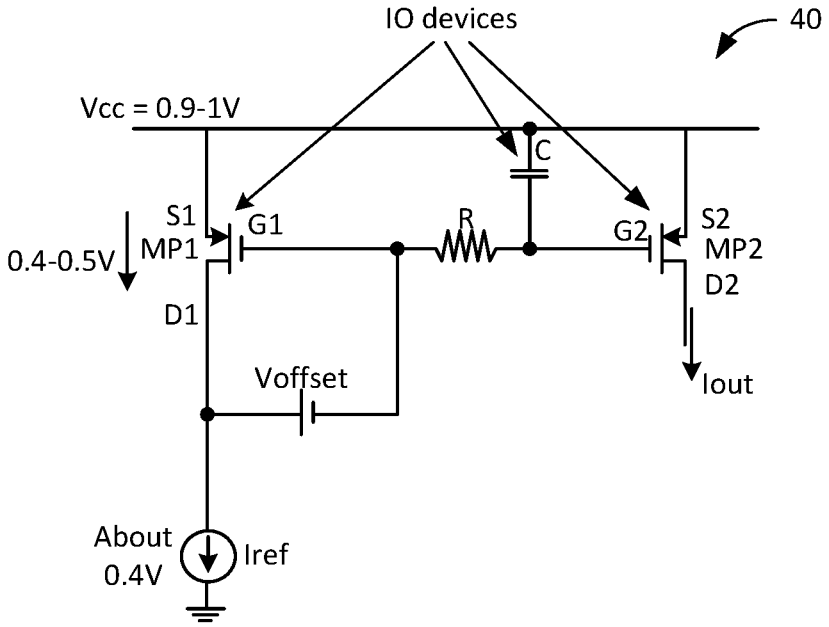
FIG. 4 is a circuit diagram of a low-noise current mirror circuit 40 according to an embodiment of the present invention.

FIG. 4 is a circuit diagram of a low-noise current mirror circuit 40 according to an embodiment of the present invention. Current mirror circuit 40 includes p-channel transistors MP1 and MP2, a current reference source Iref, a resistor R, a capacitor C, and a voltage offset circuit having an offset voltage Voffset. Transistors MP1 and MP2 each are IO devices, i.e., transistors MP1 and MP2 each have a relatively high voltage threshold. Referring to FIG. 4, MP1 has a source S1 coupled to a core supply voltage Vcc (e.g. 0.9V to 1V), a gate G1 coupled to one end of resistor R and a drain D1 coupled one end of the current reference source Iref and one end of the voltage offset circuit Voffset. MP2 has a source S2 coupled to the core supply voltage Vcc, a gate G2 coupled to another end of the resistor R and one end of the capacitor C, and a drain D2 that provides an output current Iout to a load. In the embodiment, the offset voltage Voffset is added between the gate G1 and one end of the resistor R to ensure that the voltage at the drain D1 is high enough to provide at least 0.4V to the current reference source Iref.

Figure 5:
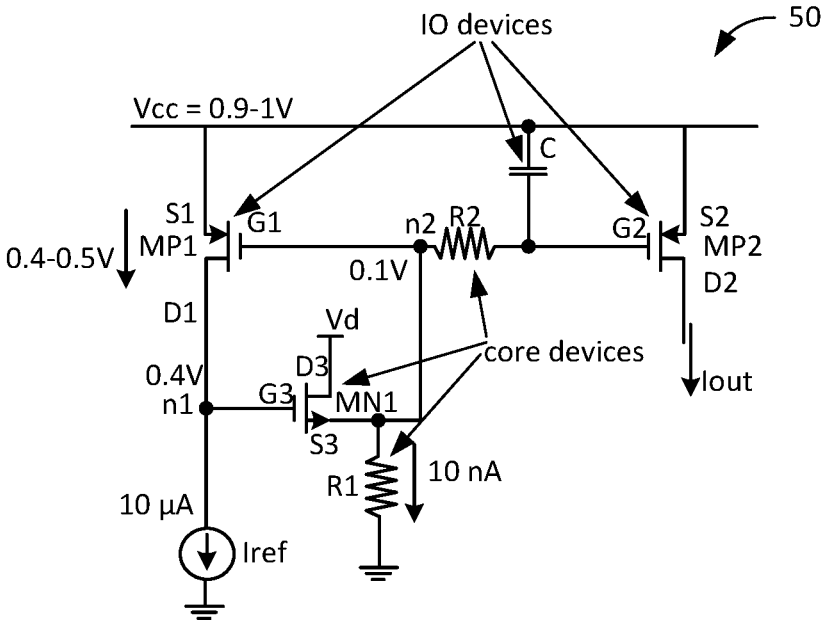
FIG. 5 is a schematic diagram of a low-noise and low voltage current mirror circuit 50 according to an embodiment of the present invention.

FIG. 5 is a schematic diagram of a low-noise and low voltage current mirror circuit 50 according to an embodiment of the present invention. Current mirror circuit 50 provides the advantages of low voltage supply, low noise reference current, and insensitivity to the supply voltage variations. Referring to FIG. 5, current mirror circuit 50 may include a first p-channel MOS (PMOS) transistor MP1, a second p-channel MOS transistor MP2, a current source Iref, an n-channel MOS (NMOS) transistor MN1, and a first resistive element R1 coupled between a source of the NMOS transistor MN1 and a ground potential. First PMOS transistor MP1 has a source S1 connected to a supply voltage Vcc, a drain D1 connected to the current source Iref at a node n1, and a gate G1 connected to a source S3 of the NMOS transistor MN1. NMOS transistor MN1 has a gate G3 connected to the current source Iref at the node n1, and the source S3 connected to the gate G1 of first transistor MP1 and to one end of first resistive element R1. Second PMOS transistor MP2 has a source S2 connected to the supply voltage Vcc, and a gate G2 connected to the gate G1 of first transistor MP1 through a second resistive element R2. Current mirror circuit 50 may further include a capacitive element C disposed between the supply voltage Vcc and the gate G2 of second transistor MP2. The second resistive element R2 has one end connected to the source S3 of NMOS transistor MN1 and the gate G1 of first PMOS transistor MP1 at a node n2. The second resistive element R2 and the capacitive element C form together a low-pass filter having a time constant R2C configured to filter noise of the current source Iref. In one embodiment, NMOS transistor MN1 is a native device or a core device such that transistor MN1 has a low threshold voltage.

In one embodiment, the n-channel MOS transistor MN1 is configured to compensate for the variation of the supply voltage Vcc. When the supply voltage Vcc rises, the voltage at the node n1 tends to rise. As the voltage at the node n1 is applied to the gate of the transistor MN1, the transistor MN1 tends to conduct less current, so that the voltage at the node n2 drops resulting in a drop of the drain voltage of first transistor MP1, thereby counteracting the rise of the supply voltage Vcc. The NMOS transistor operates as a negative feedback loop of the current path comprising the first transistor MP1 and the current source Iref of current mirror circuit 30.

In one embodiment, the n-channel transistor (NMOS) MN1 may be a transistor having a low threshold voltage of about 0.4V or lower. In one embodiment, the n-channel transistor MN1 may be a native transistor (e.g., with undoped channel) having a threshold voltage of approximately 0.1V or 0V. In one embodiment, the voltage Vd applied to the drain D3 of the NMOS transistor MN1 may be $Vd \geq Vg - Vt$, where Vd is the voltage applied to the drain of the NMOS transistor MN1, Vg is the voltage applied to the gate of the NMOS transistor MN1, and Vt is the threshold voltage of the NMOS transistor MN1.

In a numerical exemplary embodiment, a current mirror circuit in accordance with the present invention has a supply voltage in the range between 0.9V and 1.0V, a current source in the order of 10 μA, a voltage source-drain of the transistor MP1 is in the range between 0.4V and 0.5V, the voltage at the node n1 is about 0.4V, the voltage at the node n2 is about 0.1V, the current flowing through the resistor R2 is about 10 nA, and the resistive element R2 has a value about 10 MΩ. In one embodiment, since the drain voltage Vd has to be greater than Vg-Vt, where Vt is the threshold voltage of a native NMOS transistor, the drain voltage applied to the NMOS transistor may be chosen to be 0.6V.

Embodiments of the present invention may be utilized advantageously in a variety of applications. For example, the current mirror or the current reference circuit shown in FIGS. 4 and 5 may be used in conjunction with a digital-to-analog converter that employs an array of current sources to produce an analog output proportional to a digital input. Or, the current mirror circuit (the current reference circuit) shown in FIG. 4 or FIG. 5 may be used as an active load for amplifier stages because of its high output resistance. In one embodiment, the output current Iout can be provided to an external device (i.e., outside of the current mirror circuit) as a current source for biasing the external device.

Although specific embodiments have been illustrated and described herein, it will be appreciated by those of ordinary skill in the art that any arrangement that is derived to achieve the same purpose may be substituted for the specific embodiments shown. Many modifications of the invention will be apparent to those of ordinary skill in the art. Accordingly, this disclosure is intended to cover any modifications or variations of the invention. It is intended that this invention be limited only by the following claims and their equivalents.

What is claimed is:

1. A semiconductor device comprising:

a current source;

an input/output (IO) region comprising a first IO device and a second IO device, the first and second IO devices forming with the current source a current mirror circuit, each of the first and second IO devices having a first threshold voltage; and a core region comprising:

a first core device having a second threshold voltage lower than the first threshold voltage, the first core device coupled to the first and second IO devices and the current source and configured to provide an offset voltage to the current source;

a second core device coupled between the first and second IO devices; and a third core device having a first end coupled to the first core device and a second end coupled to a ground potential.

2. The semiconductor device of claim 1, wherein each of the second and third core devices is a resistive device.

3. The semiconductor device of claim 1, wherein the IO region further comprises:

a third IO device forming with the second core device a low-pass filter configured to filter out high-frequency components of the current source.

4. The semiconductor device of claim 3, wherein the third IO device is a capacitive device.

5. The semiconductor device of claim 1, wherein:

the first IO device is a first p-channel metal oxide semiconductor (PMOS) transistor;

the second IO device is a second PMOS transistor; and the first core device is an n-channel metal oxide semiconductor (NMOS) transistor.

6. The semiconductor device of claim 5, wherein:

the first PMOS transistor has a source coupled to a first voltage, a drain coupled to one end of the current source; and the second PMOS transistor having a source coupled to the first voltage, a gate coupled to a gate of the first PMOS transistor.

7. The semiconductor device of claim 6, wherein the NMOS transistor comprises:

a drain coupled to a second voltage lower than the first voltage;

a source coupled to a ground potential; and a gate coupled to the one end of the current source.

8. The semiconductor device of claim 7, wherein the second voltage is greater than or equal to a difference between a gate voltage applied to the gate of the NMOS transistor and the second threshold voltage.

9. The semiconductor device of claim 1, wherein the first core device is a native device.

10. A current mirror circuit comprising:

a current source;

a first transistor having a first gate and a first gate dielectric thickness;

a second transistor having a second gate coupled to the first gate of the first transistor and the first gate dielectric thickness; and a third transistor having a third gate and a second gate dielectric thickness less than the first gate dielectric thickness, the third gate of the third transistor coupled to the current source and configured to provide a voltage at the current source that is greater than a voltage at the first gate of the first transistor.

11. The current mirror circuit of claim 10, wherein the third transistor is a native transistor.

12. The current mirror circuit of claim 10, wherein:

the first transistor is a first p-channel metal oxide semiconductor (PMOS) transistor having a first source coupled to a first voltage and a first drain coupled to one end of the current source;

the second transistor is a second PMOS transistor having a second source coupled to the first voltage and a second drain configured to output a constant current; and the third transistor is an n-channel metal oxide semiconductor (NMOS) transistor having a third drain coupled to a second voltage that is lower than the first voltage.

13. The current mirror circuit of claim 12, wherein the second voltage is greater than or equal to a difference between a gate voltage at the third gate of the third transistor and a threshold voltage of the third transistor.

14. The current mirror circuit of claim 10, further comprising:

a first resistive device disposed between the first gate of the first transistor and the second gate of the second transistor; and a capacitive device coupled to the second gate of the second transistor and a supply voltage, wherein the capacitive device and the first resistive device form a low-pass filter configured to filter out high-frequency components of the current source.

15. The current mirror circuit of claim 14, further comprising a second resistive device coupled between the first gate of the first transistor and a ground potential.

16. A current reference circuit comprising:

a first voltage;

a reference current;

a first transistor having a first source coupled to the first voltage and a first drain coupled to the reference current;

a second transistor having a second source coupled to the first voltage and a second gate coupled to a first gate of the first transistor and a second drain configured to output a constant current;

a third transistor having a third drain coupled to a second voltage lower than the first voltage, a third source coupled to the first gate of the first transistor, and a third gate coupled to the reference current and configured to provide a third voltage that is higher than a voltage at the first gate of the first transistor.

17. The current reference circuit of claim 16, wherein the third transistor is a native transistor.

18. The current reference circuit of claim 16, further comprising:

a first resistor coupled between the first gate of the first transistor and the second gate of the second transistor;

a capacitor coupled between the first voltage and the second gate of the second transistor.

19. The current reference circuit of claim 16, wherein the first transistor and the second transistor each have a first threshold voltage, and the third transistor has a second threshold value that is lower than the first threshold voltage.

* * * * *